United States Patent [19]

Furr

[11] Patent Number: 5,042,272

[45] Date of Patent: Aug. 27, 1991

[54] KNITTING MACHINE FABRIC ROLL DOFFING APPARATUS

[75] Inventor: Tommy R. Furr, Oakboro, N.C.

[73] Assignee: Union Underwear Company Inc., Bowling Green, Ky.

[21] Appl. No.: 551,291

[22] Filed: Jul. 12, 1990

[51] Int. Cl.[5] ..... D04B 15/88

[52] U.S. Cl. ..... 66/151; 242/79

[58] Field of Search ..... 66/149 R, 151; 139/1 R; 242/79, 81

[56] References Cited

U.S. PATENT DOCUMENTS

| | | | |
|---|---|---|---|
| 2,429,674 | 10/1947 | Dickno | 66/151 |
| 3,839,885 | 10/1974 | Bourgeois | 66/151 |
| 3,985,001 | 10/1976 | Eschenbach | 66/149 R |
| 4,079,600 | 3/1978 | Amaya et al. | 66/151 X |
| 4,765,157 | 8/1988 | Okada | 66/151 |

FOREIGN PATENT DOCUMENTS

| | | | |
|---|---|---|---|
| 259647 | 8/1988 | German Democratic Rep. | 66/149 R |
| 63-182455 | 7/1988 | Japan | 66/149 R |

*Primary Examiner*—Wm. Carter Reynolds

*Attorney, Agent, or Firm*—Bell, Seltzer, Park & Gibson

[57] ABSTRACT

A take-up roll doffing apparatus for a circular knitting machine includes a take-up roll extending between and supported for rotation at opposite ends of the opposed side frames of the take-up frame of the knitting machine. The take-up roll is pivotably supported at one end on one of the opposed side frames and is free to swing outwardly away from the other of the opposed side frames to position the roll of fabric in a doffing position. A fabric roll receiving rod includes a free end and a supported end. The fabric roll receiving rod is supported on the floor adjacent the main frame of the knitting machine and is adapted to be manually moved between an inactive vertically disposed position and an active horizontally disposed position with the free end being aligned with the other end of the fabric take-up roll to permit longitudinal sliding of the fabric roll from the fabric take-up roll and onto the fabric roll receiving rod.

16 Claims, 3 Drawing Sheets

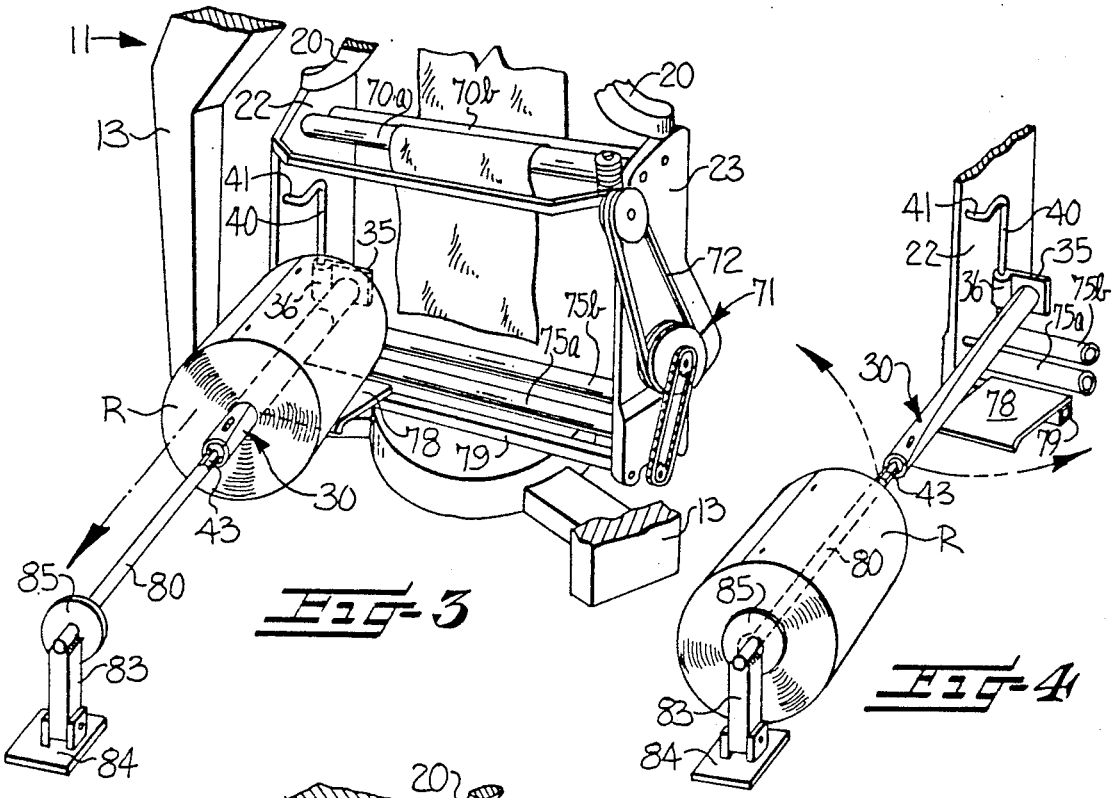
Fig-3
Fig-4
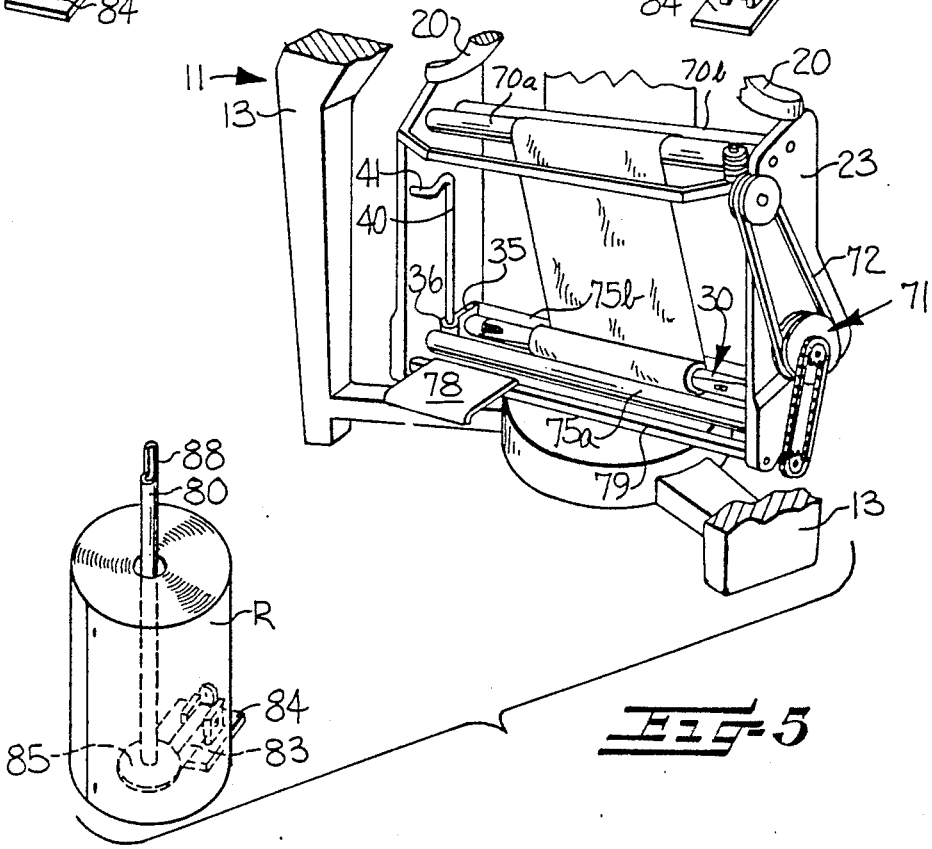
Fig-5

KNITTING MACHINE FABRIC ROLL DOFFING APPARATUS

FIELD OF THE INVENTION

This invention relates generally to a fabric take-up roll doffing apparatus for a circular knitting machine, and more particularly to such an apparatus where the take-up roll swings outwardly to thereby position the fabric roll in a doffing position.

BACKGROUND OF THE INVENTION

In a circular knitting machine, the knitted tubular fabric is wound in a flat condition on a take-up mechanism which typically includes a take-up roll rotatably supported by the frame of the take-up mechanism of the knitting machine. After a predetermined amount of knit fabric has accumulated on the take-up roll, the formed fabric roll is doffed therefrom.

Heretofore most prior art doffing apparatus have been complex and time consuming to operate, or require an operator's physical exertion in removing the formed fabric roll from the knitting machine. Some apparatus use a separate truck or buggy for receiving the fabric roll to lessen the amount of operator exertions required to doff the fabric roll. However, these apparatus also are complex and suffer other drawbacks. For example, U.S. Pat. No. 4,079,600 to Amaya et al discloses a complex doffing apparatus having a truck pivotally supported on the knitting machine. The truck swings inwardly under the fabric roll and then swings outwardly therefrom for removing the roll. As disclosed, the knitting machine must stop when the fabric roll is oriented in a preselected position before the fabric roll is removed. In another complex apparatus disclosed in U.S. Pat. No. 3,985,001 to Eschenbach, a special doffing handle is operated to unroll the fabric roll for lowering the fabric roll onto a separate buggy. A core then is dropped out of a groove of the take-up roll to disengage the roll. In U.S. Pat. No. 4,765,157 to Okada, the fabric roll is deposited on a dolly after a split take-up roll is moved outwardly from opposite ends of the knitting machine.

Other doffing apparatus do not use a separate truck or dolly for receiving the formed fabric roll. Instead, they include modified take-up rolls to aid in doffing. For example, in U.S. Pat. No. 3,839,885 to Bourgeois, a receiving drawer supports the take-up roll. The receiving drawer is moved outwardly to aid in removing the formed fabric roll. In U.S. Pat. No. 2,429,674 to Dickno, guide plates are unlatched and moved to a horizontal position to remove the fabric roll. These apparatus also are complex and therefore, not as desirable.

SUMMARY OF THE INVENTION

It is therefore an object of this invention to provide a fabric take-up roll doffing apparatus which overcomes the aforementioned deficiencies of the prior art.

Another object of this invention is to provide a fabric take-up roll doffing apparatus for a circular knitting machine which includes a take-up roll extending between and supported for rotation at opposite ends of side frames of the take-up mechanism of the knitting machine and which includes one end which can swing outward to position the fabric roll in a doffing position for transfer onto a fabric roll receiving rod.

These and other objects and advantages of the present invention are accomplished by a fabric take-up roll doffing apparatus for use on a circular knitting machine which includes a rotatable needle cylinder, a take-up frame, a take-up roll extending between and supported for rotation at opposite ends of the opposed side frames of the take-up frame of the knitting machine, and drive means for rotating the take-up roll so that the fabric produced by the knitting machine is rolled onto the take-up roll.

The doffing apparatus includes support means carried by one of the opposed side frames and rotatably supporting one end of the take-up roll for rotation as the fabric is wound thereon. The support means includes pivot means to permit the other end of the take-up roll to swing outwardly away from the other of the opposed side frames and to thereby position the roll of fabric in a doffing position.

The take-up roll includes an outer, tubular configured sleeve having first and second half sleeve members extending substantially the entire length of the roll and subdividing the sleeve into respective halves. The first half sleeve member is fixed and has a converging cam surface along the substantial length thereof converging in a direction toward the outward pivoting end. The second half sleeve member has a corresponding diverging surface which is slidable on the first fixed half sleeve member converging cam surface so that as the second sleeve member is moved downward and along the cam surface, the effective diameter of the take-up roll is decreased for facilitating withdrawal of a fabric roll wound on the take-up roll. Means is included for limiting sliding movement of the second half sleeve member on the first fixed half sleeve member.

A fabric roll receiving rod is included and provided with a free end and a supported end. The receiving rod is supported by means fixed on the floor and adjacent the main frame of the knitting machine and is pivotally connected to the supported end of the fabric roll receiving rod for permitting the fabric roll receiving rod to be manually moved between an inactive vertically disposed position and an active horizontally disposed position with the free end being aligned with the other end of the fabric take-up roll to permit longitudinal sliding of the fabric roll from the fabric take-up roll and onto the fabric roll receiving rod.

BRIEF DESCRIPTION OF THE DRAWINGS

Other objects and advantages will appear as the description proceeds when taken in connection with the accompanying drawings, in which

FIG. 3 is a fragmentary perspective view of the lower portion of the knitting machine of FIG. 1 showing the take-up roll connected to and aligned with the fabric roll receiving rod;

FIG. 4 is a fragmentary perspective view of the doffing apparatus showing the fabric roll being doffed onto the fabric roll receiving rod;

FIG. 5 is a fragmentary perspective view of the lower portion of the knitting machine of FIG. 1 showing the fabric roll receiving rod moved to an inactive, vertically disposed position, and with the take-up roll in position to begin winding fabric thereon;

DESCRIPTION OF THE PREFERRED EMBODIMENT

Figure 1:
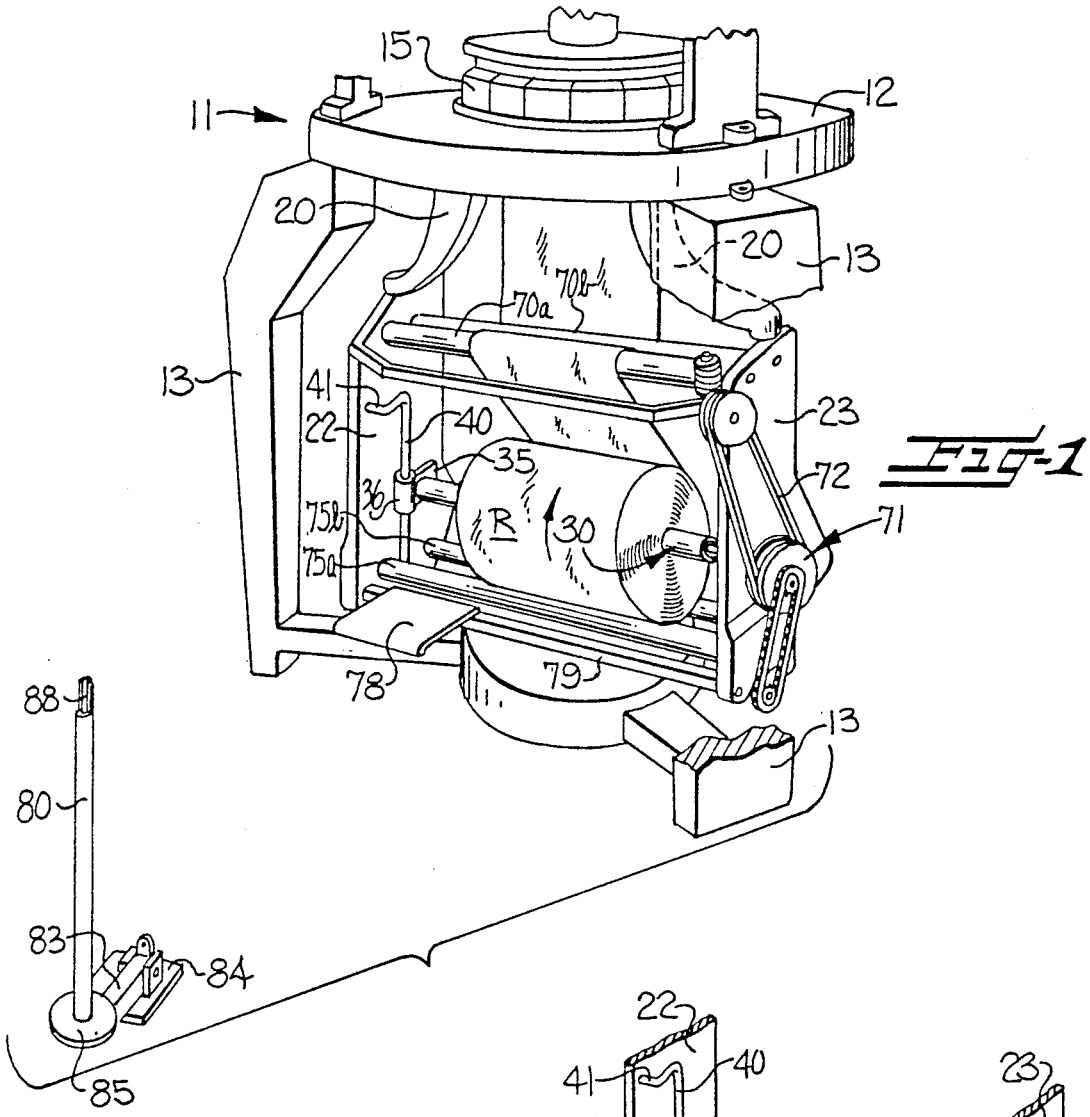
FIG. 1 is a fragmentary perspective view of a conventional type of circular knitting machine having a doffing apparatus in accordance with the present invention and showing the take-up roll extending between and supported for rotation at opposite ends of opposed side frames of the take-up frame, and with the fabric roll receiving rod being disposed in an inactive and vertical position.

The fabric take-up roll doffing apparatus of the present invention is illustrated in FIG. 1 as being mounted on a conventional type of circular knitting machine, broadly indicated at 11, including a circular bed plate 12 supported on the upper ends of spaced-apart legs 13. Only two of the legs 13 are shown in FIG. 1 and the machine is normally supplied with a third leg on the back side (not shown). A conventional needle cylinder 15 is supported for rotation in the bed plate 12. A fabric take-up frame extends beneath the needle cylinder 15 and includes a pair of support brackets 20, the upper ends of which are fixed on the rotatable needle cylinder 15 and the lower ends of which support the upper ends of respective side frame members 22, 23.

A fabric take-up roll, broadly indicated at 30, is supported between the lower ends of the sideframe members 22, 23 for winding flattened fabric into a roll as it is produced by the knitting machine 11. The take-up roll 30 is supported for rotation at one end onto the side frame member 22 where it is pivotably supported thereto. The take-up roll 30 includes a take-up roll stub shaft 31 (FIG. 6) extending coaxially outward therefrom and supported for rotation by means of a mounting bearing bracket 32 bolted to a pivoting support bracket 35. The pivoting support bracket 35 includes a collar 36 supported for vertical and pivoting movement on a vertical rod 40. The upper and lower ends of the rod 40 have laterally extending members 41 which allow the rod 40 to be bolted to the side frame member 22. The mounting bracket 32 and stub shaft 31 are free to slide vertically on an axis defined by the Vertical rod 40 as illustrated in FIGS. 1–4. On the other end of the take-up roll 30 a second stub shaft 43 is positioned and is supported for vertical sliding movement in a receiving channel (not shown) on the opposing side frame member 23 for locking the shaft thereto and preventing outward pivoting of the take-up roll 30.

Figures 6, 7, 8:
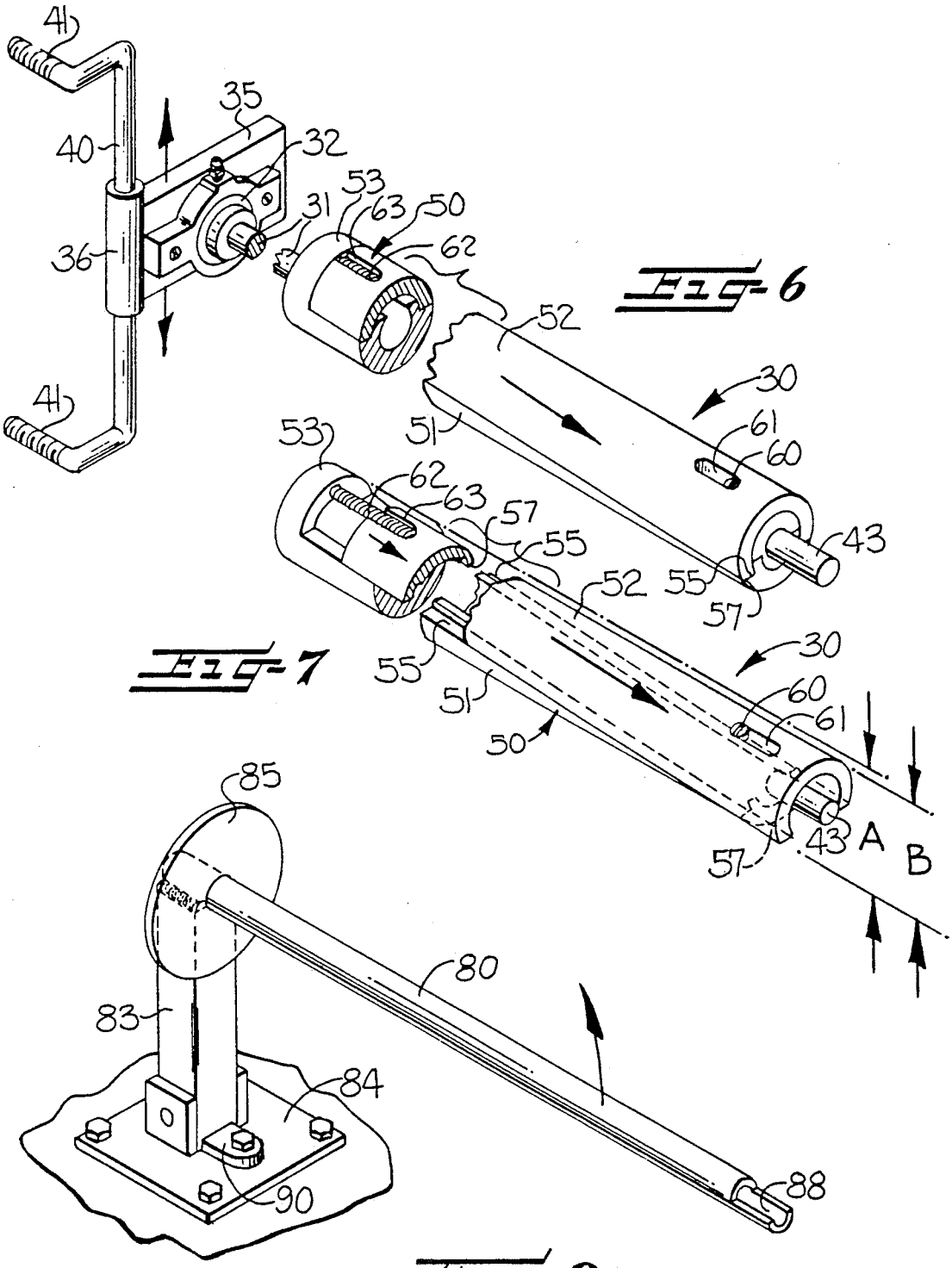
FIG. 6 is an enlarged, partially exploded broken perspective view of the take-up roll and the pivot and support means for allowing pivoting of the take-up roll.
FIG. 7 is an enlarged broken perspective view of the take-up roll and showing sliding engagement of the first and second half sleeve members.
FIG. 8 is an enlarged perspective view of the fabric roll receiving rod in an active horizontally disposed position.

Referring now more particularly to FIGS. 6 and 7, there is illustrated in detail the construction of the take-up roll 30. The take-up roll 30 includes an outer tubular configured sleeve 50 which is subdivided in half lengthwise for forming respective first and second half sleeve members 51, 52 which extend the substantial length of the roll. Each half sleeve member 51, 52 engages the other respective half sleeve member along the length thereof for forming the outer sleeve 50. The first half sleeve member 51 is fixed and includes a rear annular portion 53 and cut-out portion forming a converging cam surface 55 along the substantial length thereof and converging in a direction toward the outward pivoting or free end of the take-up roll 30. The second half sleeve member 52 includes a corresponding diverging cam surface 57 slidable on the first fixed half sleeve member converging cam surface 55. As the second half sleeve member 52 is moved along the first half sleeve member 51 as shown in FIG. 7, it moves downwardly on the converging cam surface 55 so that the effective diameter of the take-up roll 30 is decreased from a first larger diameter A to a second smaller diameter B for facilitating withdrawal of a fabric roll R wound on the take-up roll 30 (FIG. 7).

A pin 60 secured on the interior of the take-up roll extends vertically upward from the first fixed half sleeve member 51 through a slot 61 formed on the moveable second half sleeve member 52. The slot 61 is dimensioned to engage the pin 60 and limit outward sliding movement of the second half sleeve member 52 on the first fixed half sleeve member 51 a predetermined distance for preventing the second half sleeve member 52 from disengaging completely therefrom during sliding (FIG. 6). A spring 62 (FIG. 7) interconnects the first fixed half sleeve member 51 to a second rear slot 63 on the second half sleeve member 52. As the second half sleeve 52 member slides outwardly and downwardly on the converging cam surface 58, the spring 62 is pulled to create a biasing force on the sliding second half sleeve member 52 to pull that sleeve member 52 inwardly and upwardly on the converging cam surface 55.

Conventional upper and lower fabric tensioning rolls **70*a*, 70*b* (FIG. 1) are rotatably supported by the upper portions of the side frame members 22, 23. Drive means broadly indicated at 71 in FIGS. 1 and 5 is provided to rotate the tensioning rolls 70*a*, 70*b* and includes conventional belt and pulley means 72. The belt and pulley means 72 also rotates spaced drive rolls 75*a*, 75*b* on which the fabric roll R is supported. The drive rolls 75*a*, 75*b* are rotatably supported on the opposing side frame members 22, 23, and rotate the fabric roll R at the proper speed during knitting to aid in maintaining proper tension during formation of the fabric roll R. A fabric roll support plate 78 is fixed on a support bar 79. extending between and fixed at opposite ends on the side frame members 22, 23**, for purposes to be presently described.

Adjacent the main frame of the knitting machine 11, a fabric roll receiving rod 80 is positioned (FIG. 8). The fabric roll receiving rod 80 preferably is formed from tubular material and includes a free end and a supported end fixed to the free end of a pivot bracket arm 83. The other end of the pivot bracket arm 83 is pivotally supported to a support plate 84 which is bolted to the floor in a predetermined position adjacent the knitting machine. An end flange 85 is positioned on the fabric roll receiving rod 80 adjacent the pivot bracket arm 83 to stop the sliding of a formed fabric roll R onto the fabric roll receiving rod 80, as will be explained later in detail. The fabric roll receiving rod 80 includes a cut-out portion on the free pivoting end to form a receiving channel 88. An adjustable stop 90 extends outwardly from the pivot bracket arm 83 and engages the support plate 84 to prevent further pivoting movement of the pivot bracket arm 83 when it is moved to the horizontal position.

As illustrated, the fabric roll receiving rod 80 can be moved between an inactive vertically disposed position (FIGS. 1, 2 and 5) where the pivot bracket arm 83 is oriented horizontally on the support plate 84 to an active horizontally disposed position (FIGS. 3, 4 and 6–8) with the free end of the fabric roll receiving rod 80 positioned in the horizontal position. The support plate 84 is positioned on the floor so that when the fabric roll receiving rod 80 is horizontally disposed in its active position, the free end is aligned with the other end of the fabric take-up roll 30 when the fabric take-up roll is swung outwardly from the knitting machine so that the second stub shaft 43 of the take-up roll 30 is received into the receiving channel 88.

METHOD OF OPERATION

During knitting, the knitted fabric is fed through the fabric tensioning rolls 70*a*, 70*b* and onto the take-up roll 30. The fabric accumulates on the take-up roll 30 to form the fabric roll R such as illustrated in FIGS. 1–4. As the fabric roll R increases in diameter during knitting, the fabric roll R engages and is driven by the spaced drive rolls 75*a*, 75*b*. For accommodating the increasing diameters of the fabric roll as more knit material is accumulated, the take-up roll 30 slides upward on the vertical rod 40 until the formed fabric roll R is of the desired diameter.

Figure 2:
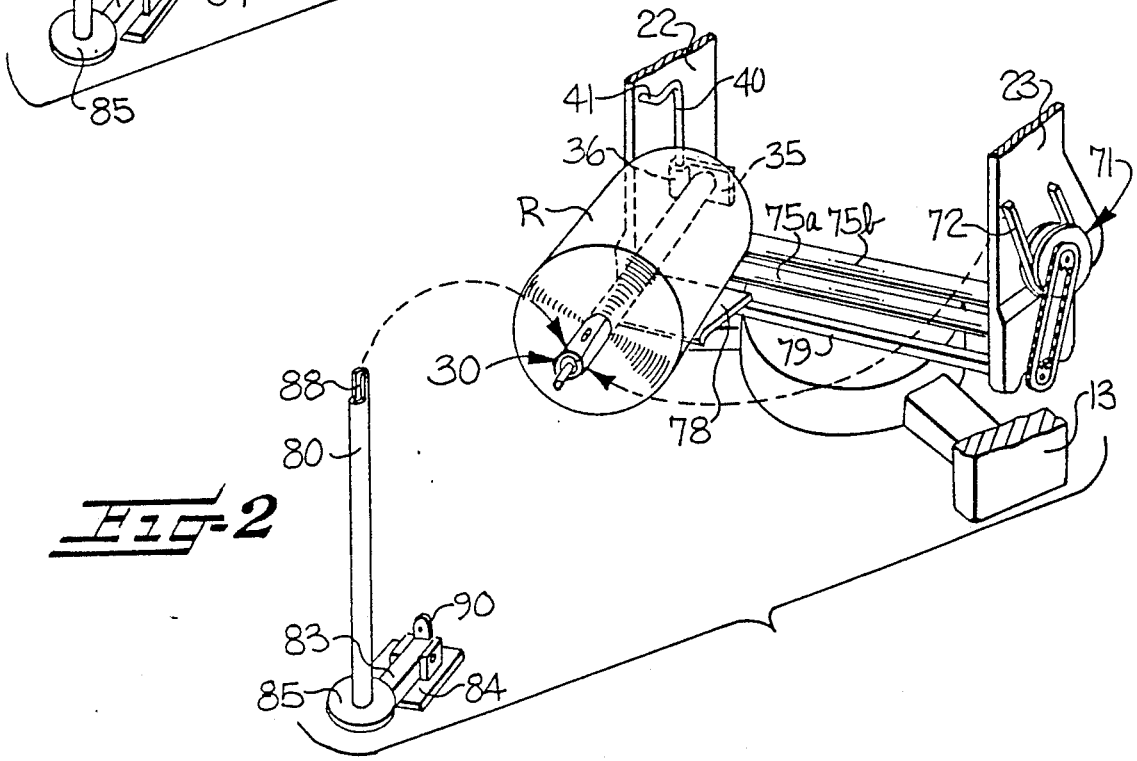
FIG. 2 is a fragmentary perspective view of the lower portion of the knitting machine of FIG. 1 wherein one end of the take-up roll is pivoted outward.

When a predetermined diameter of the formed fabric roll R has been reached, the operator stops the machine and transversely cuts the knit fabric. The operator disengages the free end of the take-up roll 30 from the slot of the side frame member 23 and manually pivots the take-up roll outward (FIGS. 2 and 3). At this time the lower surface of the fabric roll R will engage the support plate 78 (FIG. 3) and prevent downward movement of the fabric roll R. The operator then manually pivots the fabric roll receiving rod 80 into its active horizontal position and engages the second stub shaft 43 of the take-up roll 30 into the receiving channel 88 of the fabric roll receiving rod (FIG. 3). The operator pulls on the formed fabric roll R and slides the fabric roll from the take-up roll 30 onto the fabric roll receiving rod 80 (FIG. 4). As the operator pulls on the fabric roll, the second half sleeve member 52 slides downward and moves inwardly on the converging cam surface of the first fixed half sleeve member 51. The effective diameter of the take-up roll 30 is thus reduced and the formed fabric roll R is free to slide onto the fabric roll receiving rod 80 with little resistance. The take-up roll 30 then is pivoted inward to its initial position where a second fabric roll R is started (FIG. 5). The fabric roll receiving rod 80 is pivoted upward into its inactive position where the fabric roll R is prevented from sliding off the fabric roll receiving rod 80 by the end flange 85. The doffed fabric roll R (FIG. 5) is then in a convenient position to be covered with a plastic bag or the like and sent to further processing.

In the drawings and specification there has been set forth the best mode presently contemplated for the practice of the present invention and although specific terms are employed, they are used in a generic and descriptive sense only and not for purposes of limitation, the scope of the invention being defined in the claims.

That which is claimed is:

1. A fabric take-up roll doffing apparatus for circular knitting machines including a rotatable needle cylinder supported for rotation in the upper portion of a main frame, the lower end of said main frame being supported on a floor, a take-up frame supported for rotation with said needle cylinder and including opposed side frames, a take-up roll extending between and supported for rotation at opposite ends on said opposed side frames, and drive means for rotating said take-up roll so that fabric produced by the knitting machine is rolled onto said take-up roll, and wherein said fabric take-up roll doffing apparatus comprises support means carried by one of said opposed side frames and rotatably supporting opposed ends of said take-up roll for rotation as the fabric is wound thereon, said support means including pivot means carried by one of said opposed side frames to permit one end of said take-up roll to swing outwardly away from the other of said opposed side frames and to thereby position the roll of fabric in a doffing position, a fabric roll receiving rod including a free end and a supported end, and means fixed on the floor and adjacent said main frame of said knitting machine and being connected to the supported end of said fabric roll receiving rod for permitting said fabric roll receiving rod to be manually moved between an inactive vertically disposed position and an active horizontally disposed position with said free end being aligned with said other end of said fabric take-up roll to permit longitudinal sliding of the fabric roll from said fabric take-up roll and onto said fabric roll receiving rod.

2. The apparatus as claimed in claim 1 wherein said means permitting said fabric roll receiving rod to be manually moved between an inactive vertically disposed position and an active horizontally disposed position includes a pivot bracket arm fixed to said supported end of said fabric roll receiving rod and means connected to said pivot bracket arm for pivotably supporting said bracket arm so as to allow pivoting of said pivot bracket arm and said fabric roll receiving rod connected thereto.

3. The apparatus as claimed in claim 1 wherein said take-up roll includes an outer tubular configured sleeve being subdivided in half lengthwise for forming first and second half sleeve members extending the substantial length of the roll, each half sleeve member engaging the other respective half sleeve member for forming said outer sleeve, said first half sleeve member being fixed and including a converging cam surface along the length thereof and converging in a direction toward the outward pivoting end of the take-up roll, said second half sleeve member including a corresponding diverging surface and being slidable on said first fixed half sleeve member converging cam surface so that as said second half sleeve member is moved downwardly on said cam surface, the effective diameter of said take-up roll is decreased for facilitating withdrawal of a fabric roll wound on said take-up roll.

4. The apparatus as claimed in claim 3 including means limiting sliding movement of said second half sleeve member on said first fixed half sleeve member.

5. The apparatus as claimed in claim 3 including means biasing said second half sleeve member for movement upwardly along said converging cam surface.

6. The apparatus as claimed in claim 1 wherein said support means includes a vertical rod connected to one of said side frames in spaced relation thereto, a take-up roll support bracket pivotably mounted to said vertical rod and slidable thereon to allow said take-up roll to move vertically relative to said side frame for accommodating greater amounts of fabric being taken-up resulting in increasing diameters of fabric accumulated on the take-up roll.

7. The apparatus as claimed in claim 1 wherein said take-up roll and said fabric roll receiving rod each includes means positioned on the free ends of the respective roll and rod for securing said fabric roll receiving rod and said take-up roll in alignment so that said take-up roll and said fabric roll receiving rod can be connected coaxially with each other for permitting longitudinal sliding of the formed fabric roll from said fabric take-up roll onto said fabric roll receiving rod.

8. The apparatus as claimed in claim 7 wherein said means positioned on the free end of said take-up roll for securing said take-up roll to said fabric roll receiving rod includes a stub shaft, and said means positioned on the fabric roll receiving rod for securing said take-up roll to said fabric roll receiving rod includes a receiving channel adapted to receive said stub shaft therein.

9. The apparatus as claimed in claim 1 including fabric tensioning rolls positioned above said take-up roll and supported at opposite ends to said opposed side frame members.

10. The apparatus as claimed in claim 9 wherein said drive means interconnects said take-up roll and said fabric tensioning rolls for driving said take-up roll and said fabric tensioning rolls in unison.

11. A method of doffing a fabric take-up roll on a circular knitting machine including a rotatable needle cylinder supported for rotation in the upper portion of the main frame, the lower end of the main frame being supported on a floor, a take-up frame extending below the needle cylinder and including opposed vertically extending side frames, a fabric take-up roll extending between and supported for rotation at opposite ends on the opposed side frames, and drive means for rotating the take-up roll so that fabric produced by the knitting machine is rolled onto the take-up roll, and comprising cutting the fabric after a fabric roll of predetermined size has been formed on the take-up roll so that the fabric roll is free to be doffed, pivoting the take-up roll so that one end of the take-up roll swings outwardly away from the other end of the opposed side frames, orienting a fabric roll receiving rod into connecting, coaxial relationship with the take-up roll, and transferring the formed fabric roll onto the fabric roll receiving rod by sliding the formed fabric roll from the take-up roll and onto the fabric roll receiving rod.

12. The method as defined in claim 11 wherein the fabric roll receiving rod is oriented into connecting, coaxial relationship with the take-up roll by moving the rod between an inactive vertically disposed position and an active horizontally disposed position with the free end being aligned with the free end of the fabric take-up roll.

13. The method as defined in claim 12 wherein the fabric roll receiving rod is manually moved between the inactive and active positions.

14. The method as defined in claim 11 wherein as the formed fabric roll slides from the take-up roll to the fabric roll receiving rod, the effective diameter of the take-up roll is decreased for facilitating withdrawal of the formed fabric roll wound on the take-up roll.

15. The method as defined in claim 14 wherein the take-up roll includes an outer tubular configured sleeve being subdivided in half lengthwise for forming first and second half sleeve members extending the substantial length of the roll, each half sleeve member engaging the other respective half sleeve member for forming the outer tubular configured sleeve, the first half sleeve member being fixed and having a converging cam surface along the length thereof and converging in a direction toward the outwardly pivoting end of the take-up rod, the second half sleeve member having a corresponding diverging surface and being slidable on the first fixed half sleeve member converging cam surface so that as the formed fabric roll slides from the take-up roll onto the fabric roll receiving rod, the second half sleeve member is pulled outwardly and slides on the first fixed half sleeve member so that the effective diameter of the take-up roll is decreased for facilitating withdrawal of the fabric roll wound on the take-up roll.

16. The method as defined in claim 11 wherein the fabric roll receiving rod is moved from the active to the inactive vertically disposed position after the formed fabric roll is transferred onto the fabric roll receiving rod.

* * * * *